US005596334A

United States Patent [19]

Boyce et al.

[11] Patent Number: 5,596,334

[45] Date of Patent: Jan. 21, 1997

[54] ANTENNA ASSEMBLY WITH INTEGRATED INSTALLATION SUPPORT

[75] Inventors: Michael A. Boyce, Margate; Orville T. Moyer, Jr., Palm Springs, both of Fla.

[73] Assignee: Motorola, Inc., Schuamburg, Ill.

[21] Appl. No.: 523,579

[22] Filed: Sep. 5, 1995

[51] Int. Cl.[6] ..... H01Q 1/24

[52] U.S. Cl. ..... 343/702; 343/900; 343/901

[58] Field of Search ..... 343/702, 888, 343/900, 901, 906; 455/89, 90; H01Q 1/24

[56] References Cited

U.S. PATENT DOCUMENTS

| | | | |
|---|---|---|---|
| 4,760,401 | 7/1988 | Imazeki | 343/702 |
| 4,868,576 | 9/1989 | Johnson, Jr. | 343/702 |
| 5,079,558 | 1/1992 | Koike | 343/702 |
| 5,343,213 | 8/1994 | Kottke et al. | 343/702 |
| 5,436,633 | 7/1995 | Liu | 343/702 |

*Primary Examiner*—Hoanganh T. Le
*Attorney, Agent, or Firm*—Andrew S. Fuller

[57] ABSTRACT

An antenna assembly (120) includes a threaded casing (140) movably mounted on an antenna element (150). The antenna element (150) and threaded casing (140) have corresponding catches (155, 145) that engage when positioned with a particular orientation. The antenna element forms a torque driver that secures the threaded casing (140) to a support structure (125) when the catches engage and the antenna element (150) rotated, thereby installing the antenna element (150).

17 Claims, 2 Drawing Sheets

ANTENNA ASSEMBLY WITH INTEGRATED INSTALLATION SUPPORT

TECHNICAL FIELD

This invention relates in general to antennas, and more particularly to antenna assemblies mounted to communication devices.

BACKGROUND OF THE INVENTION

Communication devices, such as portable radios and cellular phones, often incorporate an antenna assembly with an extendible portion. In such devices, an antenna element is extended for higher antenna gain when the communication device is in use. The antenna element is retracted when no longer needed to present a more compact package. A typical prior art example of this type of antenna assembly can be found in U.S. Pat. No. 4,868,576 issued to Johnson, Jr., entitled Extendable Antenna For Portable Cellular Telephones With Ground Radiator. Another example is found in U.S. Pat. No. 5,343,213, issued to Kottke, et al., on Aug. 30, 1994, for a Snap-In Antenna Assembly, which is hereby incorporated by reference.

The prior art teaches a variety of ways to attach an extendible antenna to a communication device. There are many factors involved in choosing an attachment approach, including considerations for space consumption, aesthetics, durability, and facility for assembly and disassembly. One approach that is widely practiced has a slidable antenna element mounted within a threaded sleeve that is secured to a portion of the housing for a communication device. An example of this approach is described in U.S. Pat. No. 5,079,558, issued to Koike on Jan. 7, 1992 for an Extendable Antenna Device, which is hereby incorporated by reference. In the Koike patent, a threaded sleeve encases an extendible antenna element. The threaded sleeve includes a protruding head portion that provides a gripping surface for screwing the threaded sleeve within a corresponding threaded retainer attached to a communication device. The protruding head presumably supports the assembly and disassembly of the extendible antenna. For modern compact communication devices, such protruding head may be considered to be space consuming and not aesthetically appealing. Moreover, notwithstanding a variety of available designs, it would be expected that this threaded insert approach for attaching an extendible antenna would require the use of cumbersome and potentially expensive tools.

Communication devices having an extendible antenna attached by a threaded sleeve have been found to have satisfactory performance. However, these type of antenna assemblies typically require a tool for assembly and disassembly. The requirement of special tools for installation of an extendible antenna creates manufacturing difficulties and limits the ability to offer a user install option. Therefore, it is desirable to have an extendible antenna assembly that facilitates installation.

DETAILED DESCRIPTION OF THE PREFERRED EMBODIMENT

Figure 1:
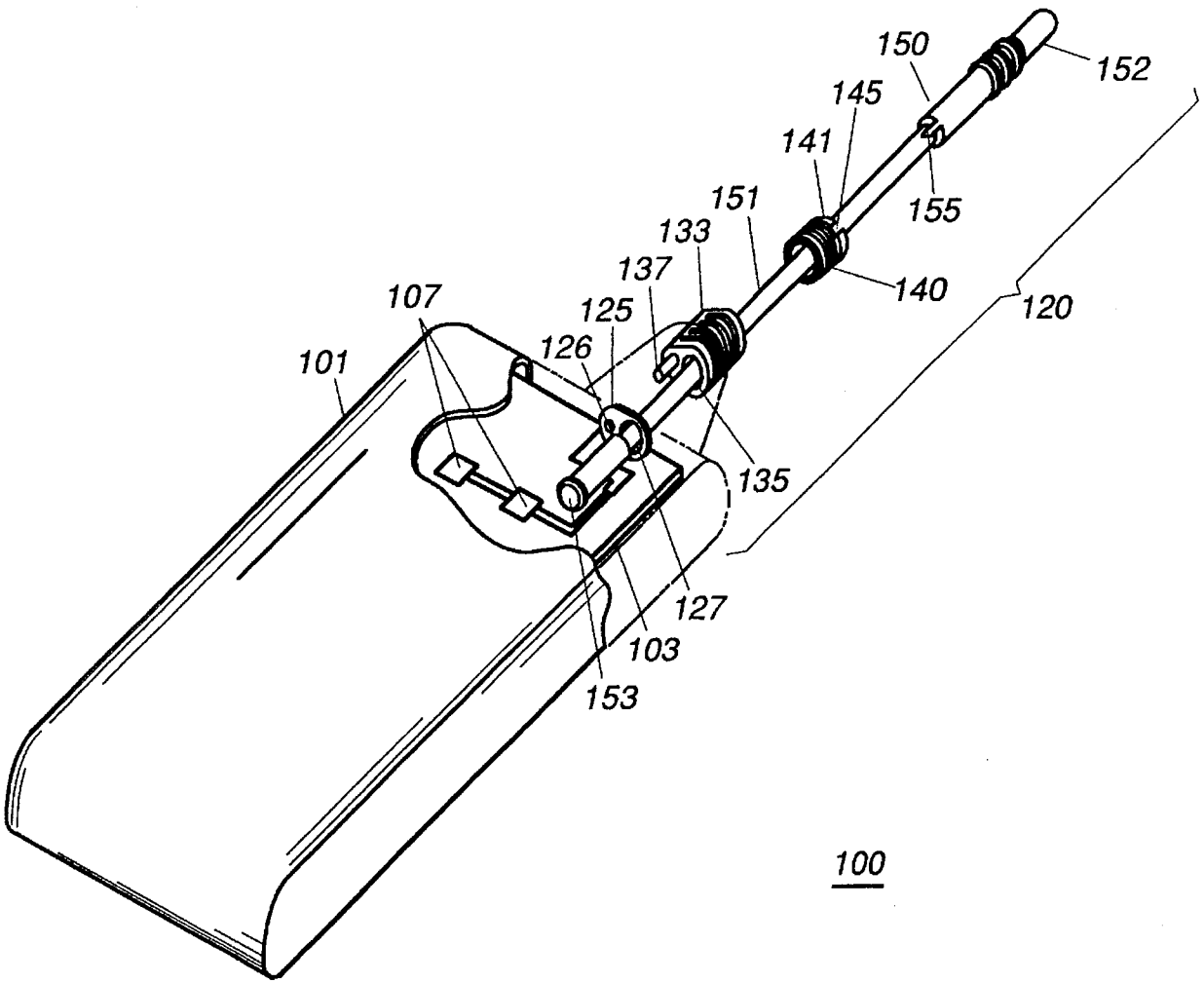
FIG. 1 is a fragmentary exploded view of a radio communication device having an antenna assembly with a retractable/extendible portion, in accordance with the present invention.

While the specification concludes with claims defining the features of the invention that are regarded as novel, it is believed that the invention will be better understood from a consideration of the following description in conjunction with the drawing figures, in which like reference numerals are carded forward.

Generally, the present invention provides for an antenna assembly with integrated installation support. The antenna assembly includes an extendible antenna element having an integrated catch, and a casing or sleeve, movably mounted around the antenna element, that has a corresponding catch which mates with the catch on the antenna element. The antenna element and casing are installed on to a support structure within a communication device. Preferably, the casing and support structure have complementary threading. During installation, the casing is positioned against the support structure, and the antenna element positioned and oriented such that its catch mates with the catch on the casing. The antenna element then forms a torque driver, when rotated, that secures the casing onto the support structure, thereby installing the antenna element.

Referring to FIG. 1, a fragmentary exploded view of a radio communication device 100 is shown, in accordance with the present invention. The radio communication device 100 includes a housing 101, that encloses a printed circuit board 103. The printed circuit board 103 carries radio communication circuitry 107 for communicating over a radio frequency channel, and has a well known configuration. The radio circuitry 107 interfaces with an antenna assembly 120 to receive and transmit communication signals. The antenna assembly 120 is mechanically and electrically coupled to the printed circuit board 103.

The antenna assembly 120 includes a threaded retainer 125, an inductor element 133, a threaded casing or sleeve 140, and an extendible/retractable antenna element 150. The threaded retainer 125 is soldered to the printed circuit board 103 for mechanical or structural support, and is electrically connected to the circuitry 107 of the radio communication device. The retainer is preferably formed from metal, and has a female threaded hole 127 as a receptacle that receives the threaded casing 140. The printed circuit board 103 and threaded retainer 125 form a support structure for securing the remainder of the antenna assembly 120. The retainer also includes a hole or receptacle 126 for interfacing with the inductor element 133.

The inductor element 133 comprises a conductor helically wound around a dielectric material having a center passage 135 extending therethrough that slidably accommodates the antenna element 150. The inductor 133 provides electrical or inductive coupling between antenna element 150 and the radio circuitry 107 on the printed circuit board 103 through the retainer 125. Accordingly, the inductor element includes a pin 137 for electrical interface to the retainer 125. Upon installation, the inductor element 133 is mounted on the retainer 125, and the pin 137 positioned within the receptacle 126, thereby forming an electrical interface.

The antenna element 150 comprises a radiator encased in a protective material. The antenna element 150 is preferably formed by overmolding a polyester material onto a radiator coil formed form conductive material such as copper wire. Such construction is typical in the art. In the preferred embodiment, the antenna element has a slender cylindrical section 151 that is capped at one end by a protruding cylindrical head portion 152, that is of larger diameter that the slender portion 151. The head portion 152 may contain a helical coil to effect specific antenna performance characteristics when the antenna element 150 is retracted. The antenna element 150 further includes a flared portion or lip 153 at an opposing end to the head portion 152. According to the invention, the antenna element 150 includes an integral torque driver portion 155 formed on an exterior portion of the antenna element 150. In the preferred embodiment, the torque driver portion 155 comprises a catch formed as a projection at or near the head portion 152, and extending in a direction toward the flared end portion 153 of the antenna element 150.

The casing or sleeve 140 has a passage extending therethrough, sufficiently large to slidably accommodate the antenna element 150 within a particular range without substantially restriction. The casing in 140 is movably mounted around the slender portion 15 1 of the antenna element 150. In the preferred embodiment the threaded casing 140 is retained on the antenna element 150 at one end by the flared portion or lip 153, and at another end by the head portion 152.

The casing 140 is preferably made from metal but may be constructed from other suitable materials. The casing 140 has a threaded exterior surface that corresponds in size and shape to the threading of the retainer 125. Thus, the casing 140 may be securely inserted within the retainer 125, such as by screwing the casing 140 within the receptacle 127. According to the present invention, the threaded casing 140 has a catch 145 that mates with the catch 155 on the antenna element 150. The slot is preferably formed on an exterior portion of the threaded casing 140. In the preferred embodiment, the catch 145 on the threaded casing 140 is a slot 145 formed on a head or end portion 141 of the threading casing 140.

For installation of the antenna assembly 120, the retainer is first soldered or otherwise affixed to the printed circuit board 103 or other support structure. The inductor 133 is positioned on the retainer 125 and the pin 137 inserted into the receptacle 126. The antenna element 150 and threaded casing or insert 140 are preferably pre-assembled such that the threaded casing 140 is slidably mounted on the slender portion 151 of the antenna element 150 and constrained by the head portion 152 and end portion 153. The flared end portion 153 of the antenna element 150 is movably or slidably mounted through the inductor 133 and threaded retainer 125, and the threaded casing 140 is positioned to engage with threaded retainer 125. The threaded casing 140 is installed to the retainer 125 by positioning the antenna element 150 such that the catch 155 engages the corresponding catch 145 on the casing 140. In the preferred embodiment, the projection 155 fits within the slot 145 when the antenna element 150 has a particular orientation and is mated with the threaded casing 140. Consequently, the antenna element forms a torque driver that imparts torsional force to the threaded casing, that screws or drives the threaded casing 140 into the retainer 125 of the support structure, when the antenna element 150 is rotated in a preferred direction.

Figure 2:
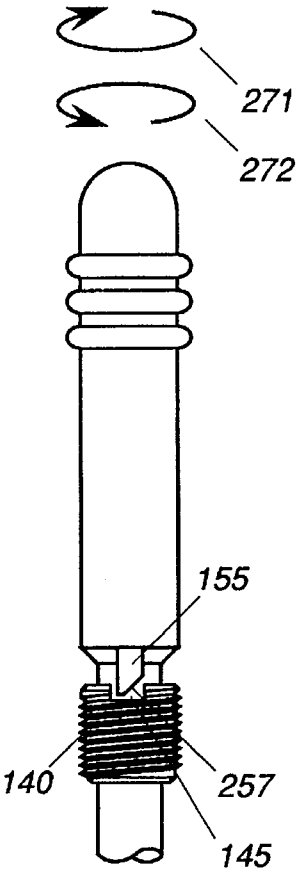
FIG. 2 is a fragmentary view of a portion of the antenna assembly of FIG. 1, in accordance with the present invention.

FIG. 2 is a fragmentary view of a portion of the antenna assembly 120, highlighting the construction of the antenna element 150 as a torque driver to install the threaded casing 140 onto the retainer 125, in accordance with the present invention. In the preferred embodiment, the projection 155 is has a tapered end 257. When the tapered end 257 is mated with the slot 145, and the antenna element rotated in a particular direction 271, the projection 155 securely engages the slot 145 and imparts substantial torsional force. However, when the antenna element 150 is rotated in a direction 272 opposite to the preferred direction 271, the tapered projection 155 easily disengages from the slot 145, and imparts very little torsional force in the opposite direction 272. This configuration is particularly useful for avoiding unwanted or inadvertent disassembly of the casing 140 from the retainer 125.

Figure 3:
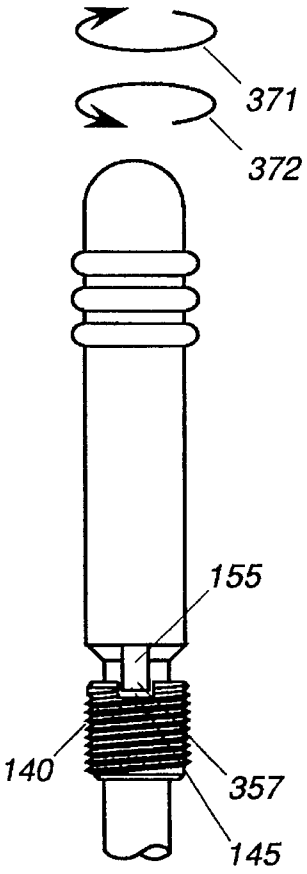
FIG. 3 is a fragmentary view of a portion of a second embodiment of the antenna assembly of FIG. 2, in accordance with the present invention.

FIG. 3 is a fragmentary view of a portion of a second embodiment of the antenna assembly, in accordance with the present invention. Here, the catch 155 has a substantially rectangular end 357 that fits the slot 145, to impart substantial torsional force on the casing 140 when mated with the slot 145 and rotated in either direction 371,372. In this embodiment, the antenna element 150 can be used to assemble and disassemble the threaded casing 140 to/from the retainer 125.

One skilled in the art would appreciate that the particular configuration of the catch 155 located on the antenna element 150, and the catch 145 located on the threaded insert 140, may vary while utilizing the concepts embodied in the present invention. For example, the threaded insert 140 may have a projection thereon, and the antenna element 150 may have a corresponding slot. Notably, catches on the antenna element and on the threaded casing may have a variety of shapes which would yield a locking function such that the antenna element becomes a torque driver when mated together with the threaded casing.

The present invention provides significant benefits over the prior art. By incorporating an integral torque driver portion 155 on the antenna element, the antenna element 150 can be used as a tool for securing the antenna assembly 120 to the support structure of the communication device. Consequently, the antenna assembly can be designed to require no external tools for assembly, thus facilitating features such as user installation. Moreover, the torque driver portion of the antenna element can be formed to be effective when rotated in one direction and to be substantially ineffective when rotated in the opposite direction thereby facilitating assembly while restricting disassembly. These and several other features are made available with the present invention.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. An antenna assembly with integrated installation support, comprising:

an antenna element having a first catch integrally formed thereon;

a threaded casing movably mounted around the antenna element, the threaded casing having a second catch that mates with the first catch; and a support structure having a threaded retainer;

wherein the antenna element is slidably mounted through the threaded retainer and is extendible and retractable with respect to the support structure, and the antenna element, including the first catch, forms a torque driver tool that engages the second catch, temporarily during intallation of the antenna element, to cause the threaded casing to be secured to the threaded retainer when the antenna element is rotated.

2. The antenna assembly of claim 1, wherein one of the first and second catches comprises a projection and another of the first and second catches comprises a slot.

3. The antenna assembly of claim 2, wherein:

the projection is formed on an exterior portion of the antenna element; and the slot is formed on an exterior portion of the threaded casing.

4. The antenna assembly of claim 3, wherein the projection fits within the slot when the antenna element has a particular orientation and is mated with the threaded casing, such that the antenna element forms a driver that imparts torsional force to the threaded casing that screws the threaded casing to the threaded retainer when the antenna element is rotated in a preferred direction.

5. The antenna assembly of claim 4, wherein the projection has a tapered end that causes disengagement of the projection from the slot when the antenna element is mated with the threaded casing, and rotated in a direction opposite to the preferred direction.

6. An antenna assembly with integrated installation support, comprising:

an antenna element having a first catch thereon;

a threaded casing movably mounted around the antenna element, the threaded casing having a second catch formed to mate with the first catch; and a support structure having a threaded retainer;

wherein the antenna element forms a driver that temporarily engages the threaded casing, via the first and second catches, to impart torsional force to the threaded casing that secures the threaded casing to the threaded retainer of the support structure, when the antenna element has a particular orientation and is mated with the threaded casing, and the antenna element is rotated in a preferred direction, to install the antenna element.

7. The antenna assembly of claim 6, wherein:

the first catch comprises a projection formed on an exterior portion of the antenna element; and the second catch comprises a slot formed on an exterior portion the threaded casing.

8. The antenna assembly of claim 7, wherein the projection has a tapered end that causes disengagement of the projection from the slot when the antenna element is mated with the threaded casing, and rotated in a direction opposite to the preferred direction.

9. An antenna assembly, comprising:

an antenna element having a torque driver portion formed thereon;

an insert mounted on the antenna element and movable about a portion of the antenna element; and a support structure having a receptacle for the insert;

wherein the antenna element is slidably mounted within the support structure and is extendible and retractable with respect to the support structure, and the torque driver portion imparts torsional force on the insert to secure the insert to the support structure, when the insert engages the receptacle, the torque driver portion has a particular orientation and engages the insert, and the antenna element rotated in a particular direction.

10. The antenna assembly of claim 9, wherein the insert has a slot to receive the torque driver portion and the torque driver portion comprises a projection with a tapered end.

11. The antenna assembly of claim 9, wherein the insert and receptacle have complementary threading.

12. An antenna assembly, comprising:

an extendible and retractable antenna element;

a threaded casing movably mounted on the antenna element;

a support structure that receives the threaded casing;

wherein:

the antenna element and threaded casing have corresponding catches that engage when positioned while having a particular orientation; and the antenna element forms a torque driver that temporarily engages the threaded casing, via the corresponding catches, during installation of the antenna element, to secure the threaded casing to the support structure when the antenna element is rotated.

13. A radio communication device, comprising:

a radio housing;

a circuit substrate mounted within the radio housing and having radio circuitry;

a retainer mounted within the radio housing;

an inductor element having a passage extending therethrough, the inductor element being mounted to the retainer and being electrically coupled to the radio circuitry;

an extendible antenna element movably mounted within the passage of the inductor element, the antenna element having a first catch formed thereon; and a casing securely mounted around the antenna element and movable about a portion of the antenna element, the casing having a second catch that selectively mates with the first catch;

wherein the antenna element forms a driver that engages the casing and imparts torsional force to secure the casing to the retainer, when the first and second catches are mated, and the antenna element rotated in a preferred direction.

14. The radio communication device of claim 13, wherein the casing and retainer have complementary threading.

15. The radio communication device of claim 14, wherein the casing comprises an insert with a threaded exterior.

16. The radio communication device of claim 13, wherein:

the first catch comprises a projection formed on an exterior portion of the antenna element; and the second catch comprises a slot formed on an exterior portion the casing.

17. The radio communication device of claim 16, wherein the projection has a tapered end that causes disengagement of the projection from the slot when the antenna element is mated with the casing, and rotated in a direction opposite to the preferred direction.

* * * * *